United States Patent [19]

Voorheis

[11] 4,132,007

[45] Jan. 2, 1979

[54] SINGLE BURNER HEATER AND INCINERATOR

[76] Inventor: James T. Voorheis, 53 Park La., Essex Fells, N.J. 07021

[21] Appl. No.: 825,257

[22] Filed: Aug. 17, 1977

[51] Int. Cl.[2] ..... F26B 3/04

[52] U.S. Cl. ..... 34/35; 34/86; 34/155; 34/219; 432/8; 432/59

[58] Field of Search ..... 432/8, 72, 59, 222, 432/223, 179, 152; 34/86, 35, 219, 23, 33, 155

[56] References Cited

U.S. PATENT DOCUMENTS

| | | | |
|---|---|---|---|
| 2,029,580 | 2/1936 | Menkt | 432/179 |
| 2,750,680 | 6/1956 | Houdry et al. | 432/8 |
| 2,804,694 | 9/1957 | Clipsham | 432/72 |
| 3,130,961 | 4/1964 | Verner et al. | 432/72 |
| 3,437,321 | 4/1969 | Wilkinson | 432/72 |
| 3,486,841 | 12/1969 | Betz | 34/35 |
| 3,917,444 | 11/1975 | Canthew | 432/72 |
| 3,942,264 | 3/1976 | Zenkner | 432/72 |
| 4,065,251 | 12/1977 | Croft et al. | 432/59 |

*Primary Examiner*—Henry C. Yuen

*Attorney, Agent, or Firm*—Norman N. Popper; Daniel H. Bobis

[57] ABSTRACT

A combination heater, a processing oven and incinerator in which a single burner constitutes the source of heat for processing materials in an oven and also constitutes the means of incinerating the products of combustion to an innocuous residue, capable of being discharged into the air without environmental damage. The products of combustion do not pass through the oven.

8 Claims, 1 Drawing Figure

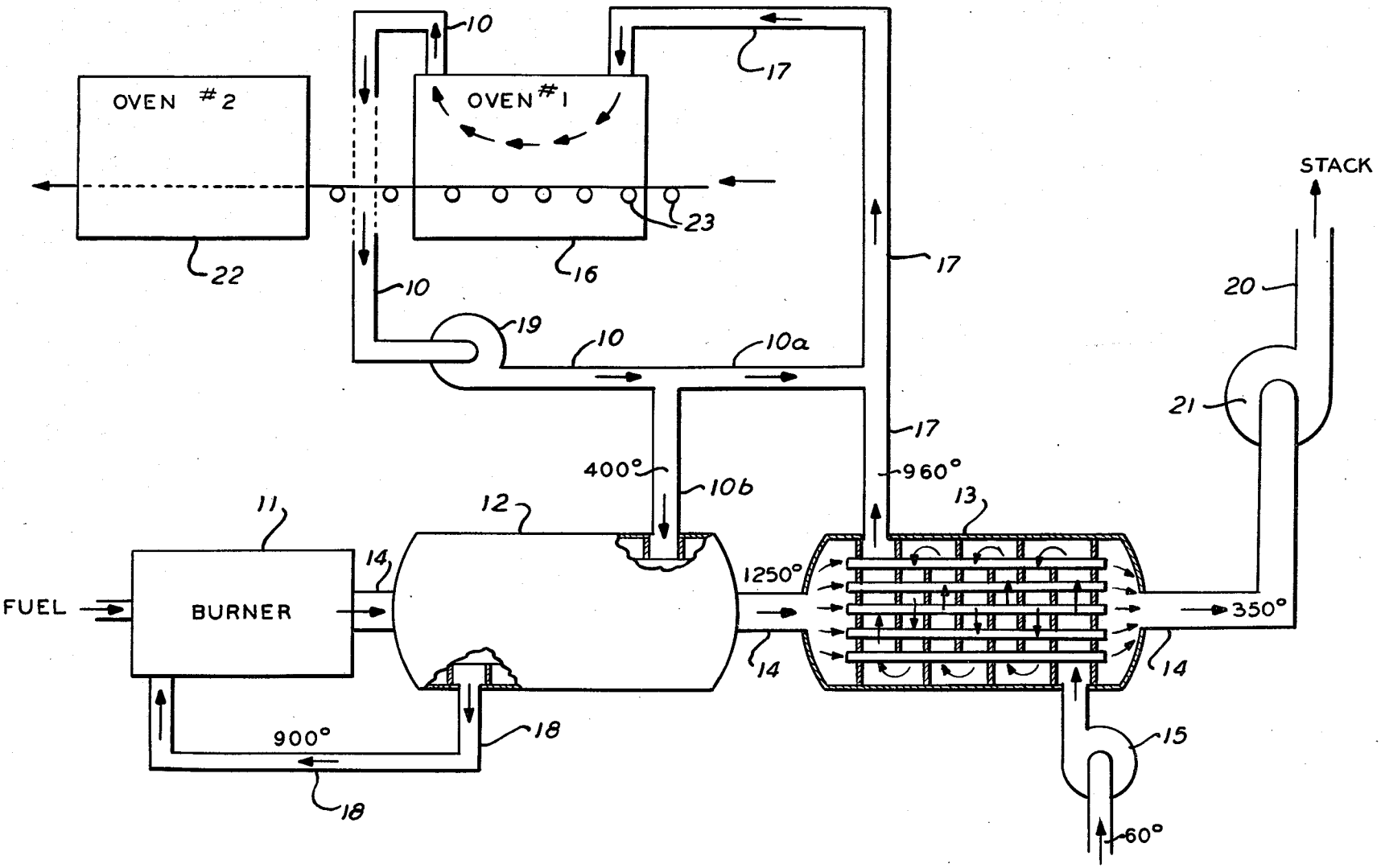
STACK
20
21
350°
14
15
60°
13
17
17
960°
17
10a
1250°
14
10b
23
400°
10
16
OVEN #1
19
12
18
10
10
14
11
BURNER
900°
18
OVEN #2
22
FUEL

SINGLE BURNER HEATER AND INCINERATOR

BACKGROUND OF THE INVENTION

1. Field of Invention

This invention relates generally to oven processing of materials, involving raising the temperature of gaseous material to processing temperature, and then incinerating the products of processing; more specifically, this invention relates to a processing oven wherein the single burner not only supplies the heat for processing, but also functions to incinerate the products of processing eliminating the need for a separate burner in an oven; one burner suffices for each of the two functions i.e., processing, and also incineration of the products of processing i.e., the volatiles from processing.

2. Prior Art

In the process for producing various products in an oven, or in a line of many ovens, wherein the materials are either placed in the oven or are passed through the oven or a series of ovens, it is well known to provide separate burners for the oven or, indeed many separate burners for the separate many ovens so that there are a multiplicity of burners in the ovens to supply the necessary heat for the performance of the processing of the material, and also separate burners for incinerating the processing volatiles. The products of processing likewise are usually conducted from the oven or ovens through various headers to one or more centrally located incinerators, each of which incinerators has a burner for reducing the products of processing such as the volatiles from the processing to innocuous gases that may be discharged into the atmosphere without harming the ecology. The use of separate burners to produce heat for processing, and heat for incineration has been the standard practice in many industries for a long period of time. Not only is this practice wasteful, but it requires accessory duplication of burners with attendant expense and maintenance costs. The steadily rising cost of solid, liquid, or gaseous fuels have subjected such procedures to careful scrutiny with a view to reducing costs. Much of this scrutiny has been directed to the use of more efficient burners. This invention relates to the reduction in the number of burners.

SUMMARY OF THE INVENTION

It has been found that a form of combination processing heating and incinerating burner can be devised, wherein the single burner will supply the necessary heat for processing in the oven and will further incinerate the products of processing such as the volatiles of processing and, convert them into innocuous gaseous products which may be discharged into the atmosphere without ecological damage. This is accomplished by eliminating the separate burner from the oven where processing takes place, and utilizing a single burner for incineration and for the generation of heated air to be conducted into the oven where the material is to be processed. The products of processing are in part recirculated to the oven, including the volatiles derived from the processing, but a part of the products of processing are returned to the burner along with the volatiles derived from processing where they are consumed and converted into relatively innocuous gaseous material. Inasmuch as the atmosphere of the oven and the products of processing are at an elevated temperature, they may be utilized to elevate the temperature of make-up air from the. second heat exchanger, which make-up air is conducted into the oven and in turn returned in part to the burner. In this manner, but one burner alone constitutes the source of heated air for processing in the oven, and likewise constitutes the means for incinerating the products of processing so that great economies are effected in the performance of the process.

THE DRAWINGS

These objects and advantages as well as other objects and advantages may be attained by the system shown by way of illustration in the drawing in which:

The FIGURE is a schematic view of the components comprising the system and there interconnection.

PREFERRED EMBODIMENT

The present system provides a burner 11 for burning liquid or gaseous fuel. A duct 14 conducts the heated products of combustion through a first heat exchanger 12 and out therefrom, through a second heat exchanger 13. The products of combustion may reach a temperature of approximately 1250° F. when passing from the first heat exchanger 12 to the second heat exchanger 13. The products of combustion leaving the second heat exchanger may be drastically reduced to a temperature of approximately 350° F. The utilization of two heat exchangers 12, 13 efficiently utilizes the thermal units produced by the burner 11, so that the stack temperature (representing thermal waste) is very low. It is noted that none of the products of combustion of the burner ever reach the oven 16, but they are utilized in two heat exchangers 12, 13 before being sent to the stack 20. Products of processing are conducted to the single burner for incineration.

A make-up air fan 15 supplies make-up air to the system by introducing it into the second heat exchanger 13, where its induction temperature of 60° F. may be raised to approximately 960° F. The conduit 14 passing through the second heat exchanger is preferably arranged for counter-flow with the make-up air passing through the second heat exchanger 13, for most efficient heat exchange. A first duct 17 conducts the heated air to an entry port in an oven 16. From the oven 16 the air and volatiles from processing leave through a second duct 10, where its temperature may have fallen to approximately 400° F. The second duct 10 is bifurcated; one bifurcated duct portion **10*a* conducts part of the air and processing volatiles from the oven to the first duct 17, through which it re-enters the oven 16. The other bifurcated duct portion 10*b* conducts the remaining portion of the air and processing volatiles to the first heat exchanger 12. The air entering the first heat exchanger 12 is exposed in heat exchange relation to the conduit 14 conducting products of combustion from the burner 11. In passing through the first heat exchanger 12, the air is preferably conducted in counterflow relation to the air in the conduit 14, for most efficient heat exchange. The air emerges from the first heat exchanger at approximately 900° F. It is conducted by a third duct 18 as a primary source of combustion air for the burner 11. The burner 11 is preferably arranged as close as possible to the oven 16, so that there will be a minimum heat loss between the burner and the oven in consequence of the short ducts utilized. This system, instead of requiring a separate burner in the oven, is able to function on a single burner which serves as both a heater and incinerator. The closeness of the direct fired heat exchanger 12, to prevent heat loss to the oven 16**, is an important aspect of the system.

In order to enhance the rate of movement of air through the oven 16 and through the first heat exchanger, a circulating fan 19 is positioned in the second duct 10. For the purpose of discharging the products of combustion from the conduit 14, up a stack 20 to enter the atmosphere, an exhaust fan 21 is provided at the end of the conduit 14 to propel gaseous material up the stack 20.

It is believed that:- the burner 11 may produce an initial temperature of approximately 1400° F. to 1750° F.; that conduit 14 will pass approximately 2,340,000 B.T.U./hour including heat from combustion of volatiles derived from processing in the oven 16; that the duct 17 will pass to the oven 1,770,000 B.T.U. per hour; and that the stack will discharge approximately a relatively low 570,000 B.T.U. per hour. It is assumed the make-up air from the make-up air fan 15 will enter the second heat exchanger at approximately 60° F.

The combination of direct fired first heat exchanger 12 and a second heat recovery exchanger 13 enables the use of only a single burner 11 as the heater and incinerator, which eliminates the need for a second burner in the oven, whereby great economy of operation is achieved.

It is to be understood that in referring to air in the system, there may be included volatiles derived from processing in the oven 16, but the products of combustion from the burner 11 are totally isolated from the processing oven 16.

It is further to be understood that the oven 16 is a heated zone where materials are processed, either on a batch basis, or continuously by being passed through, either as self sustaining strips, or passing from roller 23 to roller 23, or by being passed through on a conveyor. Additional subsequent ovens 22 etc. may be added as required.

A thermostat (optional, not shown) in the oven 22 may be used to govern the temperature therein by controlling the firing rate of the burner 11.

What is claimed is:

1. A single burner heater and incinerator comprising:
a. a burner,
b. a first indirect heat exchanger,
c. a second indirect heat exchanger,
d. a conduit from the burner passing through the first and second heat exchangers,
e. a means to supply make-up air to the second heat exchanger in indirect heat exchange relation to the conduit passing therethrough,
f. an oven,
g. a first duct for conducting the make-up air from the second heat exchanger to the oven,
h. a second duct for conducting the atmosphere from the oven through a first bifurcated portion in part to the first duct, and in part through a second bifurcated portion to the first heat exchanger in indirect heat exchange relation to the conduit passing therethrough,
i. a third duct for conducting air from the first heat exchanger to the burner.

2. A single burner heater and incinerator comprising:
a. the system according to claim 1,
b. a circulating fan in the second duct for driving the atmosphere from the oven in part through the first and in part through the second bifurcated portions.

3. A single burner heater and incinerator comprising:
a. the system according to claim 1,
b. a stack for discharging products of combustion,
c. the conduit from the second heat exchanger connected to the stack.

4. A single burner heater and incinerator comprising:
a. the system according to claim 1,
b. an exhaust fan in the conduit between the second heat exchanger and the stack for driving products of combustion from the burner up the stack.

5. A single burner heater and incinerator comprising:
a. The system according to claim 1,
b. The means to supply make-up air to the second heat exchanger being an air fan.

6. A single burner heater and incinerator comprising:
a. a burner,
b. a first indirect heat exchanger,
c. a second indirect heat exchanger,
d. a conduit from the burner passing through the first and second heat exchangers,
e. an air fan to supply make-up air to the second heat exchanger in indirect heat exchange relation to the conduit passing through,
f. an oven,
g. a first duct for conducting the make-up air from the second heat exchanger to the oven,
h. a second duct for conducting the atmosphere from the oven through a first bifurcated portion in part to the first duct and in part through a second bifurcated portion to the first heat exchanger in indirect heat exchange relation to the conduit passing therethrough,
i. a third duct for conducting air from the first heat exchanger to the burner,
j. a recirculating fan in the second duct for driving the atmosphere from the oven in part through the first and in part through the second bifurcated portions,
k. a stack for discharging products of combustion,
l. the conduit from the second heat exchanger connected to the stack,
m. an exhaust fan in the conduit between the second heat exchanger and the stack for driving products of combustion up the stack.

7. A method for heating and incinerating in a system using a single burner comprising:
a. burning fuel in a burner,
b. passing the products of combustion through a conduit, through a first indirect and a second indirect heat exchanger,
c. passing make-up air through the second heat exchanger in indirect heat exchange relation to the conduit therethrough,
d. passing the make-up air from the second heat exchanger to an oven,
e. passing the atmosphere from the oven in part to mix with the make-up air from the second heat exchanger to return into the oven,
f. passing the other part of atmosphere from the oven to the first heat exchanger in indirect heat exchange relation to the conduit therethrough,
g. passing atmosphere from the first heat exchanger to the burner,
h. processing material in the oven.

8. A method for heating and incinerating in a system using a single burner comprising:
a. the steps according to claim 7,
b. evacuating the products of combustion from the second heat exchanger to a stack.

* * * * *